US010469946B2

(12) United States Patent
Tao

(10) Patent No.: US 10,469,946 B2
(45) Date of Patent: Nov. 5, 2019

(54) OVER-EAR SPEAKER SYSTEM FOR HEAD-MOUNTED DISPLAY UNIT

(71) Applicant: Facebook Technologies, LLC, Menlo Park, CA (US)

(72) Inventor: David Tao, Santa Clara, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/615,711

(22) Filed: Jun. 6, 2017

(65) Prior Publication Data

US 2018/0352332 A1 Dec. 6, 2018

(51) Int. Cl.

| | |
|---|---|
| ***H04R 29/00*** | (2006.01) |
| ***H04R 3/04*** | (2006.01) |
| ***H04R 1/02*** | (2006.01) |
| ***H04R 3/00*** | (2006.01) |
| *H04R 1/10* | (2006.01) |

(52) U.S. Cl.
CPC ..... *H04R 3/04* (2013.01); *H04R 1/028* (2013.01); *H04R 3/007* (2013.01); *H04R 1/1008* (2013.01); *H04R 1/1041* (2013.01)

(58) Field of Classification Search
CPC ..... H04R 3/04; H04R 1/028; H04R 1/1008; H04R 1/1041; H04R 3/007
USPC ..... 381/59, 55, 370, 303, 301
See application file for complete search history.

(56) References Cited

U.S. PATENT DOCUMENTS

| | | | | |
|---|---|---|---|---|
| 5,533,137 | A * | 7/1996 | Holmes | H04R 1/1066 381/370 |
| 2004/0113867 | A1* | 6/2004 | Tomine | G02B 27/0172 345/8 |
| 2006/0023158 | A1* | 2/2006 | Howell | G02C 11/06 351/41 |
| 2011/0286620 | A1* | 11/2011 | Flynn | A42B 1/245 381/375 |
| 2013/0259245 | A1* | 10/2013 | Cheng | H04R 3/00 381/58 |
| 2016/0249135 | A1* | 8/2016 | Savvopoulos | H04R 3/007 |
| 2017/0006394 | A1* | 1/2017 | Risberg | H04R 3/002 |

* cited by examiner

*Primary Examiner* — Xu Mei
*Assistant Examiner* — Ammar T Hamid
(74) *Attorney, Agent, or Firm* — Fenwick & West LLP

(57) ABSTRACT

An over-ear speaker system for a head mounted display includes a speaker, an impedance detection circuit, and a sound processor. The impedance of the speaker changes according to the temperature of the speaker. The sound processor coupled to the impedance detection circuit receives an impedance signal representing the impedance of the speaker and adjusts the boosting of frequency components in the sound signal based on the impedance signal. The adjusting of boosting of frequency components in the sound signal includes boosting of a frequency range of the sound signal below a resonance frequency of a speaker and may enable the protection of the speaker from damage by adjusting boosting of frequency components near a resonance frequency of the speaker at which maximum excursion of the speaker occurs.

14 Claims, 5 Drawing Sheets

OVER-EAR SPEAKER SYSTEM FOR HEAD-MOUNTED DISPLAY UNIT

BACKGROUND

This disclosure relates generally to a speaker system in a head-mounted display (HMD), and more specifically to an over-ear speaker system in a HMD with signal boosting functionality.

HMDs typically include speakers or personal audio devices (e.g., headphones and in-ear headphones or earbuds) to provide sound to users. For good sound quality, speakers included in an HMD require a large resonance chamber for boosting of low frequencies. Thus, including speakers in an HMD typically result in the HMD having a larger volume and size, an inconvenience to the user. While a personal audio device such as earbuds may provide a lightweight and compact solution for providing sound to an HMD user, this solution provides a barrier for users to share the HMD because users typically prefer not to share their own personal audio device due to hygiene reasons.

SUMMARY

Embodiments relate to an over-ear speaker system for use in an HMD that adjusts boosting of frequency components in a sound signal based on detecting of impedance across input terminals of the speakers, the impedance representing a resonance frequency of the speaker changing due to fluctuations in temperature of the speaker. The adjustment of frequency components includes increasing a boosting of frequencies in a first frequency range of the sound signal below the resonance frequency of the speaker to enhance the low frequency bass of the sound signal. The adjustment of frequency components can also include decreasing a boosting of frequencies in a second frequency range of the sound signal including a resonance frequency of the speaker to prevent damage to the speaker. The speaker system includes an impedance detection circuit and a sound processor. The speaker has input terminals to receive a sound signal. A resonance frequency of the speaker changes based on the temperature of the speaker. The impedance detection circuit detects the impedance across the input terminals of the speaker that changes according to the temperature of the speaker. The sound processor is coupled to the impedance detection circuit and receives an impedance signal representing the impedance of the speaker. The sound processor adjusts boosting of frequency components in the sound signal based on the impedance signal.

In one embodiment, the impedance detection circuit detects the impedance across the input terminals by detecting a voltage across the input terminals and current in one of the input terminals. The impedance detection circuit may include a sense resistor having an end connected to the one of the input terminals of the speaker, and the impedance detection circuit determines the current in the one of the input terminals by detecting voltage across the sense resistor.

In one embodiment, the impedance detection circuit includes a first analog to digital converter connected to the sense resistor to receive the voltage across the sense resistor and sends a digital version of the voltage across the sense resistor to the sound processor (the voltage across the sense resistor is used to calculate to the current through the speaker) and a second analog to digital converter detects a voltage across the input terminals of the speaker and sends a digital version of the voltage across the input terminals of the speaker to the sound processor. With both the current through the speaker and voltage across the speaker, the impedance can be calculated. The sound processor computes the impedance across the input terminals of the speaker by dividing the voltage across the input terminals of the speaker by the current in the one of the input terminals.

In one embodiment, the sound processor boosts frequency components in the first frequency range of the sound signal below the resonance frequency of the speaker. The sound processor may also decrease a boosting of frequency components in the second frequency range of the sound signal including a resonance frequency of the speaker.

In one embodiment, the decrease or the increase of the boosting is performed while sound is being produced by the speaker.

In one embodiment, the sound processor boosts frequency components in a first frequency range of the sound signal below a threshold frequency. The threshold frequency may be the resonance frequency plus or minus an offset. The sound processor adjusts the threshold frequency by increasing a threshold frequency responsive to an increase of the resonance frequency and decreasing the threshold frequency responsive to a decrease of the resonance frequency.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, components, circuits, and networks have not been described in detail so as not to unnecessarily obscure aspects of the embodiments.

Embodiments relate to an over-ear speaker system for use in an HMD that adjust boosting of frequency components in sound signals received at the speaker system based on a resonance frequency of a speaker that changes due to temperature fluctuation in the speaker. The change in the resonance frequency due to the temperature fluctuation can be sensed by detecting impedance across input terminals of the speaker. Based on the detected resonance frequency, the level of boosting in lower frequency range of the sound signals can be decreased to prevent damage to the speaker.

System Architecture

Figure 1:
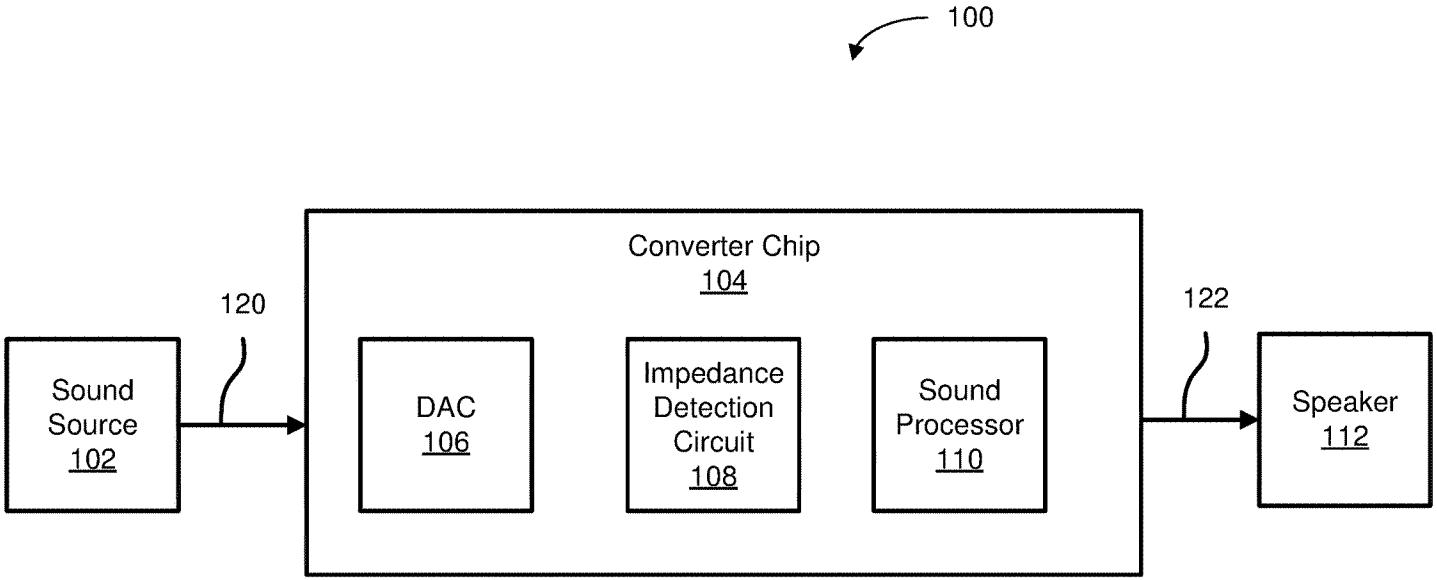
FIG. 1 is a block diagram illustrating a speaker system in accordance with an embodiment.

FIG. 1 is a block diagram illustrating a speaker system 100 in accordance with an embodiment. The speaker system 100 may include, among other components, a sound source 102, a converter chip 104, and a speaker 112. The sound source 102 supplies a sound signal 120 in the form of a voltage signal to the input of the converter chip 104. The converter chip 104 receives the sound signal 120, processes the sound signal 120, and provides a processed version 122 of the sound signal 120 to the speaker 112.

The converter chip 104 is hardware or hardware in combination with software and firmware that performs processes the sound signal received from the sound source 102. The processing performed at the converter chip 104 includes, among others, boosting of certain frequency components in the sound signal. For this purpose, the converter chip 104 may include, among other components, a digital to analog converter (DAC) 106, an impedance detection circuit 108, and a sound processor 110 for processing the sound signal, as described below in detail with reference to FIG. 2.

The speaker system 100 may include components not illustrated in FIG. 1 such as a noise filter for reducing noise in the sound signal 120.

Example Converter Chip

Figure 2:
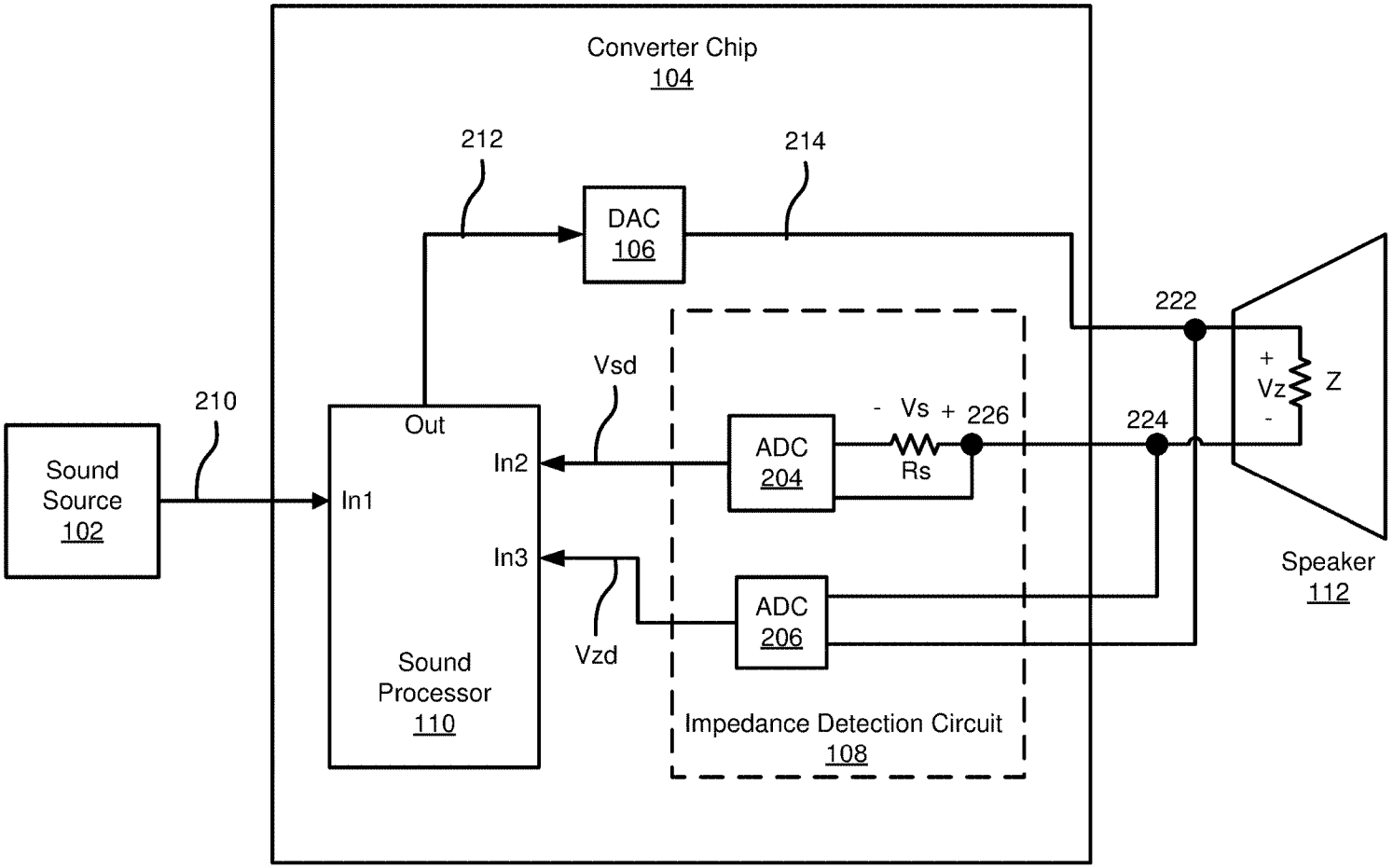
FIG. 2 is a circuit diagram of a converter chip in the speaker system of FIG. 1, in accordance with an embodiment.

FIG. 2 is a circuit diagram of the converter chip 104, in accordance with an embodiment. The sound source 102 may provide a digital signal 210 as the sound signal 120 to the converter chip 104. The digital signal 210 is received by the sound processor 110 at input terminal In1 and the sound processor may send this digital signal 210 to the output terminal Out of the sound processor 110 to be received as the digital signal 212 by the DAC 106 of the converter chip 104. The DAC 106 produces an analog signal 214 corresponding to the digital signal 212. The DAC 106 sends the analog signal 214 to the input terminals 222, 224 of the speaker 112 to produce sound at the speaker 112.

The impedance detection circuit 108 is a circuit that detects the impedance across the input terminals 222, 224 of the speaker 112 and provides an impedance signal representing the impedance of the speaker to the sound processor 110. For example, the impedance detection circuit 108 may provide the voltages Vsd and Vzd to the sound processor 110. The voltages Vsd and Vzd may represent the impedance of the speaker, as the impedance of the speaker may be expressed as a ratio of Vzd and Vsd, specifically Vzd/(Vsd/Rs). Alternatively, the impedance detection circuit 108 may compute the impedance based on the voltage signals Vsd and Vzd, or Vzd/(Vsd/Rs), where Rs is a resistance of a sense resistor, and provide the impedance to the sound processor 110. The impedance detection circuit 108 may include, among other components, an ADC 204 and an ADC 206.

The ADC 204 is a circuit that senses a current through the input terminal 224 of the speaker 112 by detecting a voltage Vs across a sense resistor Rs which has a known resistance. The ADC 204 has two input terminals, one input terminal connected to an end of the sense resistor Rs, and the other connected to a node 226 between the sense resistor Rs and the input terminal 224 of the speaker 112. The ADC 204 senses the voltage difference Vs across both of its input terminals. The ADC 204 sends a digital version Vsd of voltage difference Vs to the input terminal In2 of the sound processor 110.

The ADC 206 is a circuit that senses the voltage Vz across the input terminals of the speaker 112. The ADC 206 has two input terminals, each connected to different input terminals 222 and 224 of the speaker 112. The ADC 206 senses the voltage Vz across the input terminals of speaker 112 and sends the digital version Vzd of the voltage Vz to the input terminal In3 of the sound processor 110.

The sound processor 110 is a circuit that performs digital signal processing on the digital signal 210 by adjusting the boosting of frequency components in the digital signal 210 based on detected impedance across the input terminals of the speaker 112 to generate the digital signal 212. The sound processor 110 receives the outputs of the ADC 204 and 206, or the signal Vsd representing current through the speaker 112 and the signal Vzd representing voltage across the input terminals 222 and 224 of the speaker 112 from the impedance detection circuit 108. The impedance of the speaker 112 is the voltage across the input terminals 222 and 224 of the speaker 112 divided by the current through the speaker 112. The sound processor 110 computes the impedance by dividing the voltage Vz by the current through the speaker 112. The current through the speaker 112 is the voltage Vs across the sense resistor Rs divided by the resistance of the sense resistor Rs. Thus, the sound processor 110 computes the impedance based on the voltage signals Vsd and Vzd, or the impedance Vzd/(Vsd/Rs).

The sound processor 110 may adjust the boosting of frequency components in the sound signal based on the impedance signal. The sound processor 110 can determine the resonance frequency or the frequency of maximum excursion of the speaker based on the impedance signal, as described below in detail with reference to FIG. 3A and FIG. 3B. Based on the determined resonance frequency or the frequency of maximum excursion, the sound processor 110 may adjust the boosting of frequency components in the sound signal to boost a low frequency range below the determined resonance frequency of the speaker. The sound processor 110 may avoid or reduce the boosting of frequency components close to the determined resonance frequency of the speaker.

Adjustment of Frequency Components in the Sound Signal

The sound processor 110 determines the resonance frequency of the speaker 112 based on the impedance signal. The impedance signal during a particular time period represents the impedance of the speaker 112 at different frequency components, namely the frequency components in the sound source 102 or digital input 202. The sound processor 110 may calculate a maximum impedance of the speaker 112 from the impedance signal and determine a resonance frequency of the speaker 112 as a frequency associated with the determined maximum impedance of the speaker 112. The sound processor 110 may adjust the boosting of frequency components in the sound signal based on the determined resonance frequency. The sound processor 110 may increase a boosting of frequencies in a first frequency range of the sound signal below the resonance frequency of the speaker to enhance the low frequency bass of the sound signal. The sound processor 110 may decrease a boosting of frequencies (e.g., remove boosting of frequencies) in a second frequency range of the sound signal including a resonance frequency of the speaker to prevent damage to the speaker. For example, the resonance frequency of the speaker 112 may increase or decrease with temperature. The sound processor 110 may use the determined resonance frequency of the speaker 112 as a threshold frequency which is used in adjusting the boosting of frequency in the sound signal. That is, the sound processor 110 may raise the threshold frequency below which boosting of the frequency is performed when the resonance frequency is increased whereas drop the threshold frequency when the resonance frequency is decreased. The boosting of frequency components near the resonance frequency of the speaker 112 is also reduced as the boosting of frequency components is performed below the threshold frequency (e.g., the determined resonance frequency of the speaker 112). Thus, by reducing the boosting of frequency components near the resonance frequency of the speaker 112, the sound processor 110 is able to prevent damage to the speaker 112. In one embodiment, the sound processor 110 may update the threshold frequency as the determined resonance frequency with an offset to additionally protect the speaker 112 from damage which may occur with boosting components near the resonance frequency of the speaker 112.

Figure 3A:
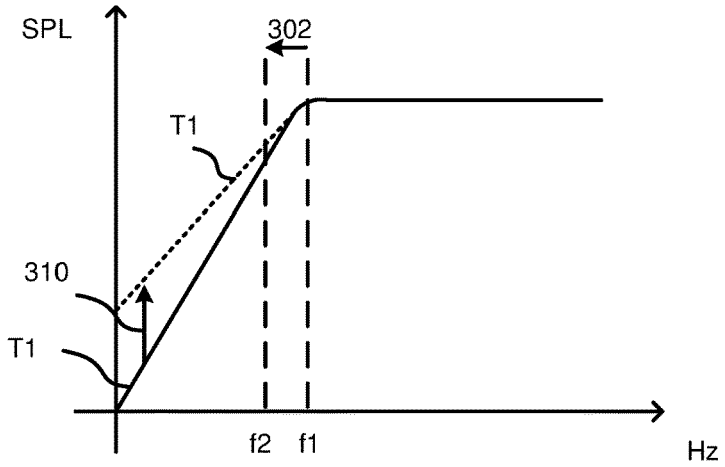
FIG. 3A is a graph illustrating is a frequency response of a speaker, in accordance with an embodiment.

FIG. 3A is a graph illustrating is a frequency response of the speaker 112, in accordance with an embodiment. The graph depicts sound pressure level (SPL) versus frequency (Hz). At a first temperature T1, the SPL of the speaker 112 has a roll-off frequency corresponding to frequency f1, or a resonance frequency of the speaker 112 below which the SPL decreases with decreasing frequency. The sound processor 110 may boost a low frequency range of the sound signal such that the SPL of speaker 112 shifts up below the resonance frequency f1 of the speaker at temperature T1, as shown by arrow 310. When the temperature of the speaker 112 changes from the first temperature T1 to the second temperature T2 as indicated by arrow 302, the sound processor 110 may also adjust boosting of frequency components in the sound signal relative to the resonance frequency f2 of the speaker at temperature T2.

In one embodiment, the sound processor 110 may boost frequency components in a first frequency range of the sound signal below a threshold frequency. The sound processor 110 may increase the threshold frequency responsive to an increase in resonance frequency and decrease the threshold frequency responsive to a decrease of the resonance frequency. The threshold frequency is based on the resonance frequency of the speaker 112. The threshold frequency may equal the resonance frequency or be the resonance frequency with an offset. This increase or decrease of the boosting may also be performed while sound is being produced by the speaker 112.

Figure 3B:
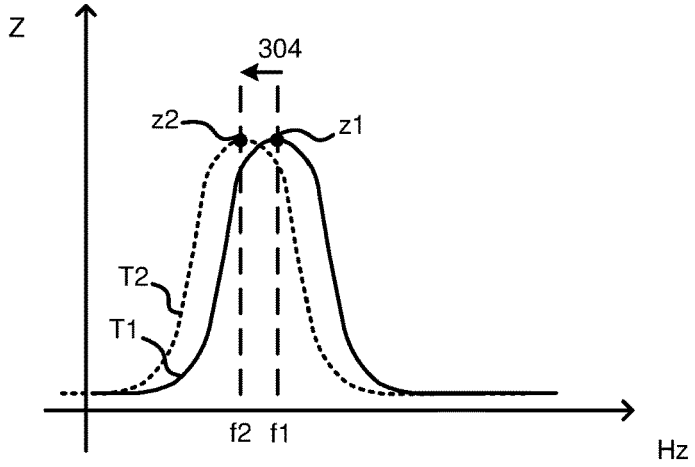
FIG. 3B is a graph illustrating an impedance response of a speaker, in accordance with an embodiment.

FIG. 3B is a graph illustrating an impedance response of the speaker 112, in accordance with an embodiment. The graph of FIG. 3B depicts impedance (Z) versus frequency (Hz) for the speaker 112. The maximum impedance of the speaker 112 at a first temperature T1 is z1 and corresponds to the frequency f1, the resonance of the speaker 112 at the first temperature T1. The maximum impedance of the speaker 112 at a second temperature T2 is z2 and corresponds to the frequency f2 of the speaker 112, the resonance frequency of the speaker 112 at the second temperature T1. When temperature of the speaker 112 increases from the first temperature T1 to the second temperature T2, the impedance response of the speaker 112 shifts left as shown by arrow 304 and the resonance frequency of the speaker shifts from f1 to f2.

Figure 3C:
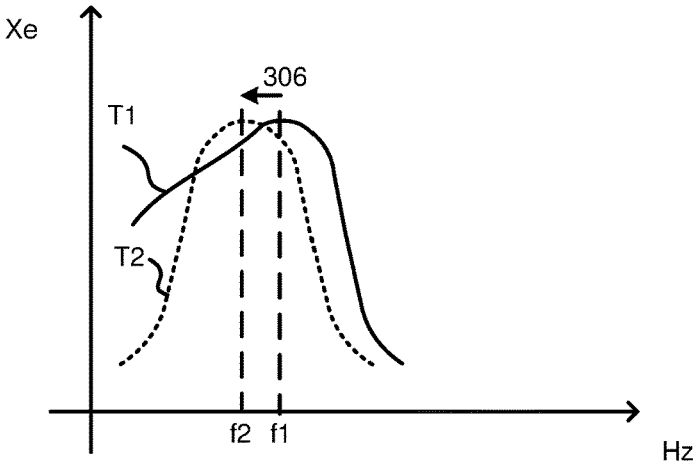
FIG. 3C is a graph illustrating excursion of a speaker with respect to frequency, in accordance with an embodiment.

FIG. 3C is a graph illustrating excursion of the speaker 112 with respect to frequency, in accordance with an embodiment. The graph of FIG. 3C depicts excursion (Xe) versus frequency (Hz) for the speaker 112 at the first temperature T1 and second temperature T2, as previously described in FIG. 3B. The excursion response of the speaker is a maximum at the resonance frequency of the speaker 112 and corresponds to the resonance frequency of the speaker 112. When the temperature increases from the first temperature T1 to the second temperature T2, the excursion response shifts left as indicated by arrow 306. The excursion response of the speaker 112 at increased second temperature T2 has a resonance frequency f2 corresponding to the maximum excursion of the speaker 112, which is lower than the previous resonance frequency f1 at the first temperature T1.

In an alternative embodiment, one or more of the components in the converter chip 104 is executed by software or firmware instead of hardware. For example, the sound processor 110 may be executed in software or firmware, but the DAC 106, ADC 204, and ADC 206 may be executed by a hardware circuit.

Method for Protecting a Speaker

Figure 4:
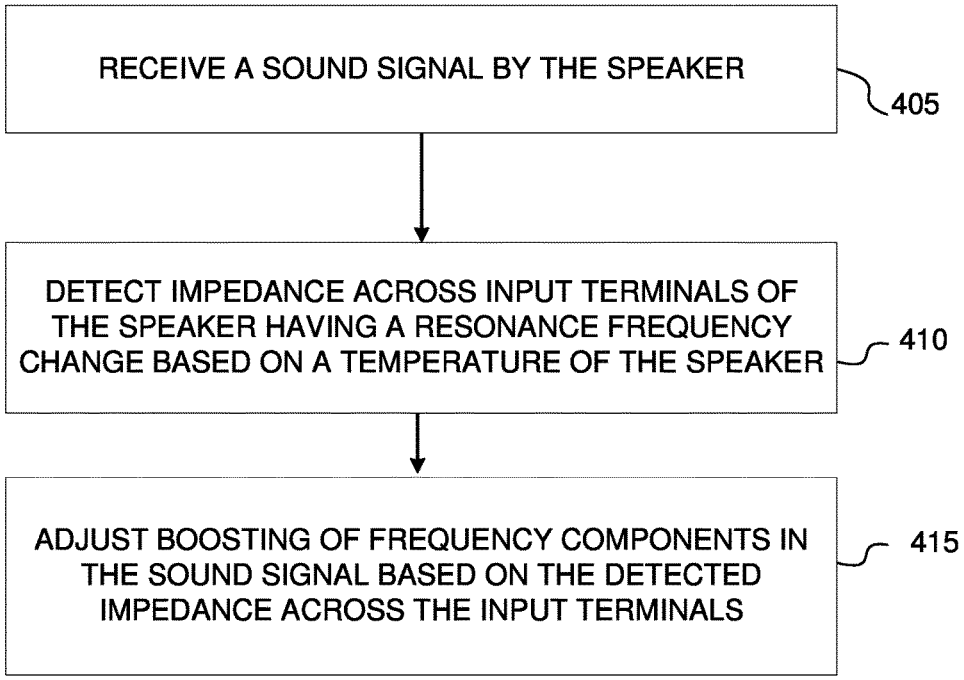
FIG. 4 is a flowchart illustrating a method of operating a speaker, in accordance with an embodiment.

FIG. 4 is a flowchart illustrating a method of operating the speaker 112, in accordance with an embodiment. The impedance detection circuit 108 receives 405 a sound signal by the speaker 112.

The impedance detection circuit 108 detects 410 impedance across input terminals of the speaker 112 having a resonance frequency change based on a temperature of the speaker 112.

The sound processor 110 adjusts 415 boosting of frequency components in the sound signal based on the detected impedance across the input terminals of the speaker 112. For example, sound processor 110 may determine a resonance frequency of the speaker based on the detected impedance and reduce the boosting of frequency components in the sound signal near a determined resonance frequency of the speaker at which maximum excursion of the speaker occurs to protect the speaker from damage.

In an alternative embodiment, one or more steps of FIG. 4 are performed in parallel instead of in sequence. For example, while the sound processor receives 405 a sound signal by the speaker, it may simultaneously be detecting 410 the impedance across the input terminals of the speaker based on a sound signal from a previous instance of time and adjusting 415 the boosting of frequency components of the sound signal.

Example HMD with Speaker

Figure 5:
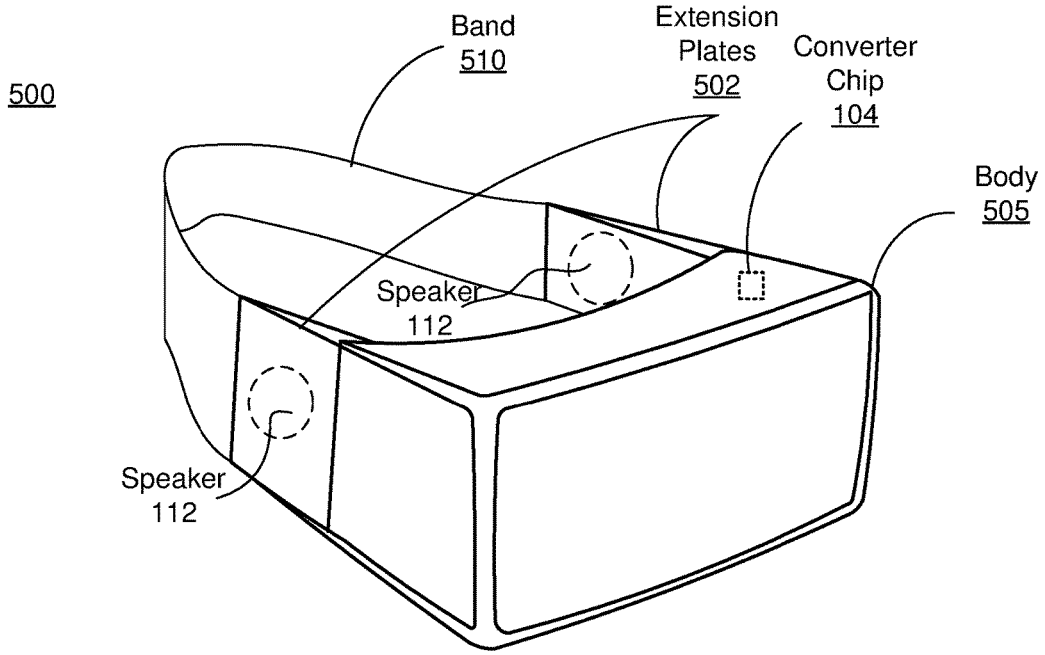
FIG. 5 is a perspective view of a HMD including a speaker with a converter chip, in accordance with an embodiment.

FIG. 5 is a HMD 500 including a speaker with a converter chip 104, in accordance with an embodiment. The HMD 500 may include, among other components, a body 505, an extension plates 502, the speakers 112, the converter chip 104, and the band 510 of the HMD 500.

The extension plates 502 extend from the body 505 of the HMD, and the speakers 112 are enclosed in the extension plates 502. To reduce volume and weight in the HMD, the speakers 112 in the extension plates 502 does not include a resonance chamber. Without the resonance chamber, the sound quality of the speakers 112 may be compromised, particularly in the low frequency components of the sound signal which require a large resonance chamber. Thus, the speakers 112 are provided for boosting in the low frequency range of the sound signal for better sound quality. However, providing too much boosting of frequencies near the resonance frequency may damage the speaker 112.

Since the resonance frequency of the speaker 112 changes with temperature, a converter chip 104 may provide adjustment for the boosting in the low frequency range of the sound signal based on changes in resonance frequency of the speaker 112. The converter chip 104 may detect a resonance frequency of the speaker 112 based on detecting an impedance of the speaker 112 and decrease boosting of the frequency components of the sound signal near the detected resonance frequency of the speaker 112, as described above with reference to FIGS. 3A through 3C.

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

What is claimed is:

1. A head mounted display (HMD) comprising:

a fixed extension plate configured to extend from a body of the HMD over a user's ear;

a speaker having input terminals to receive a sound signal, a resonance frequency of the speaker changing based on a temperature of the speaker, wherein the speaker is encased in the fixed extension plate and not provided with a corresponding resonance chamber;

an impedance detection circuit configured to detect impedance across the input terminals of the speaker, the impedance changing according to the temperature of the speaker; and a sound processor coupled to the impedance detection circuit to receive an impedance signal representing the impedance of the speaker, the sound processor configured to adjust boosting of frequency components in the sound signal based on the impedance signal, wherein the sound processor is configured to increase the boosting of the frequency components in a first frequency range below the resonance frequency of the speaker.

2. The HMD of claim 1, wherein the impedance detection circuit is configured to detect the impedance across the input terminals by detecting a voltage across the input terminals and current in one of the input terminals.

3. The HMD of claim 2, wherein the impedance detection circuit comprises a sense resistor having an end connected to the one of the input terminals of the speaker, the impedance detection circuit configured to determine the current in the one of the input terminals by detecting voltage across the sense resistor.

4. The HMD of claim 3, wherein the impedance detection circuit further comprises:

a first analog to digital converter connected to the sense resistor to receive the voltage across the sense resistor and send a digital version of the voltage across the sense resistor to the sound processor; and a second analog to digital converter configured to detect a voltage across the input terminals of the speaker and send a digital version of the voltage across the input terminals of the speaker to the sound processor.

5. The HMD of claim 3, wherein the sound processor is configured to compute the impedance across the input terminals of the speaker by dividing the voltage across the input terminals of the speaker by the current in the one of the input terminals.

6. The HMD of claim 1, wherein the sound processor is configured to decrease the boosting of the frequency components in a second frequency range of the sound signal including the resonance frequency of the speaker.

7. The HMD of claim 6, wherein the decrease or the increase of the boosting is performed while sound is being produced by the speaker.

8. The HMD of claim 1, wherein the first frequency range is below a threshold frequency, the sound processor increasing the threshold frequency responsive to an increase of the resonance frequency and decreasing the threshold frequency responsive to a decrease of the resonance frequency.

9. A method for protecting a speaker of a head mounted display (HMD), the method comprising:

receiving a sound signal by the speaker encased in a fixed extension plate configured to extend from a body of the HMD over a user's ear and not provided with a corresponding resonance chamber, a resonance frequency of the speaker changing based on a temperature of the speaker;

detecting an impedance across input terminals of the speaker, the impedance changing according to the temperature of the speaker; and adjusting boosting of frequency components in the sound signal based on the detected impedance across the input terminals of the speaker, wherein the adjusting the boosting comprising increasing the boosting of the frequency components in a first frequency range below the resonance frequency of the speaker.

10. The method of claim 9, wherein detecting the impedance across input terminals of the speaker further comprises detecting a voltage across the input terminals of the speaker and a current in one of the input terminals.

11. The method of claim 10, wherein detecting the current in one of the input terminals further comprises detecting a voltage across a sense resistor having an end connected to the one of the input terminals.

12. The method of claim 11, further comprising computing the impedance across the input terminals of the speaker by dividing the voltage across the input terminals of the speaker by the current in the one of the input terminals.

13. The method of claim 9, wherein adjusting the boosting further comprises:

decreasing the boosting of the frequency components in a second frequency range including the resonance frequency of the speaker.

14. The method of claim 9, further comprising:

increasing a threshold frequency responsive to an increase of the resonance frequency; and decreasing the threshold frequency responsive to a decrease of the resonance frequency, wherein the first frequency range is below the threshold frequency.

* * * * *